US006560802B2

(12) United States Patent
Fujii

(10) Patent No.: US 6,560,802 B2
(45) Date of Patent: May 13, 2003

(54) PILLOW WITH ALARM

(75) Inventor: Masaharu Fujii, Tokyo (JP)

(73) Assignee: Tokyo Mimore Co., Ltd. (JP)

( * ) Notice: Subject to any disclaimer, the term of this patent is extended or adjusted under 35 U.S.C. 154(b) by 0 days.

(21) Appl. No.: 09/453,371

(22) Filed: Dec. 1, 1999

(65) Prior Publication Data

US 2002/0144351 A1 Oct. 10, 2002

(30) Foreign Application Priority Data

Feb. 15, 1999 (JP) ..... 11-035970

(51) Int. Cl.[7] ..... A47G 9/00; G04B 47/00; G04B 21/00

(52) U.S. Cl. ..... 5/639; 5/636; 5/940; 5/904; 368/10; 368/12; D6/598; D6/601

(58) Field of Search ..... 5/639, 636, 940, 5/904, 490; D6/598, 601; 368/12, 10

(56) References Cited

U.S. PATENT DOCUMENTS

| | | | | | |
|---|---|---|---|---|---|
| 2,795,161 | A | * | 6/1957 | Weinman | 5/904 |
| 3,384,074 | A | * | 5/1968 | Rautiola et al. | 5/904 |
| 4,763,369 | A | * | 8/1988 | Spector | 5/636 |
| 5,072,429 | A | * | 12/1991 | Mair | 5/639 |
| D348,171 | S | * | 6/1994 | Keller | D6/601 |
| 5,684,758 | A | * | 11/1997 | Gray et al. | 368/10 |
| 5,819,346 | A | * | 10/1998 | Lane | 5/639 |

* cited by examiner

*Primary Examiner*—Alexander Grosz
(74) *Attorney, Agent, or Firm*—Lerner, David, Littenberg, Krumholz & Mentlik, LLP

(57) ABSTRACT

A pillow capable of being highly useful and convenient to a user. An alarm is arranged at a predetermined portion of a stuffed doll which is made in imitation of a real or fanciful animal or the like. The alarm may be actuated through a timer. The timer may be driven through a cell or a spring. The alarm is constructed so as to generate sound, voice, vibration, light or the like.

17 Claims, 3 Drawing Sheets

PILLOW WITH ALARM

BACKGROUND OF THE INVENTION

This invention relates to a pillow, and more particularly to a pillow provided therein with an alarm means which is highly convenient and useful to a user.

In general, a pillow is conventionally used while asleep, to thereby serve a user over a long period of time every day. Thus, a variety of pillows have been conventionally proposed which are constructed so as to permit a user to feel comfort while asleep.

One often must get up earlier than usual in view of one's schedule on that day. In such a case, one has conventionally taken a step of placing an alarm clock at one's bedside.

Unfortunately, when a mattress or futon is spread directly on the floor as in Japanese style, arrangement of an alarm clock at one's bedside floor causes hinderance. It possibly causes one to strike one's foot or the like on the clock when the one passes by the clock, to thereby be injured.

SUMMARY OF THE INVENTION

The present invention has been made in view of the foregoing disadvantage of the prior art.

Accordingly, it is an object of the present invention to provide a pillow having an alarm means incorporated therein which is capable of being highly useful and convenient to a user.

In accordance with the present invention, a pillow is provided. The pillow includes a stuffed doll made in imitation of a real animal or the like. Alternatively, the stuffed doll may be made in imitation of a fanciful or imaginary (hereinafter referred to as "fanciful") animal or the like. The pillow also includes an alarm means arranged at a predetermined portion of the stuffed doll.

In a preferred embodiment of the present invention, the alarm means is actuated through a timer.

In a preferred embodiment of the present invention, the timer is driven through a drive source selected from the group consisting of a cell and a spring.

In a preferred embodiment of the present invention, the alarm means is constructed so as to generate sound, voice, vibration, light or the like.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a pillow according to the present invention will be described hereinafter with reference to the accompanying drawings.

Figure 1:
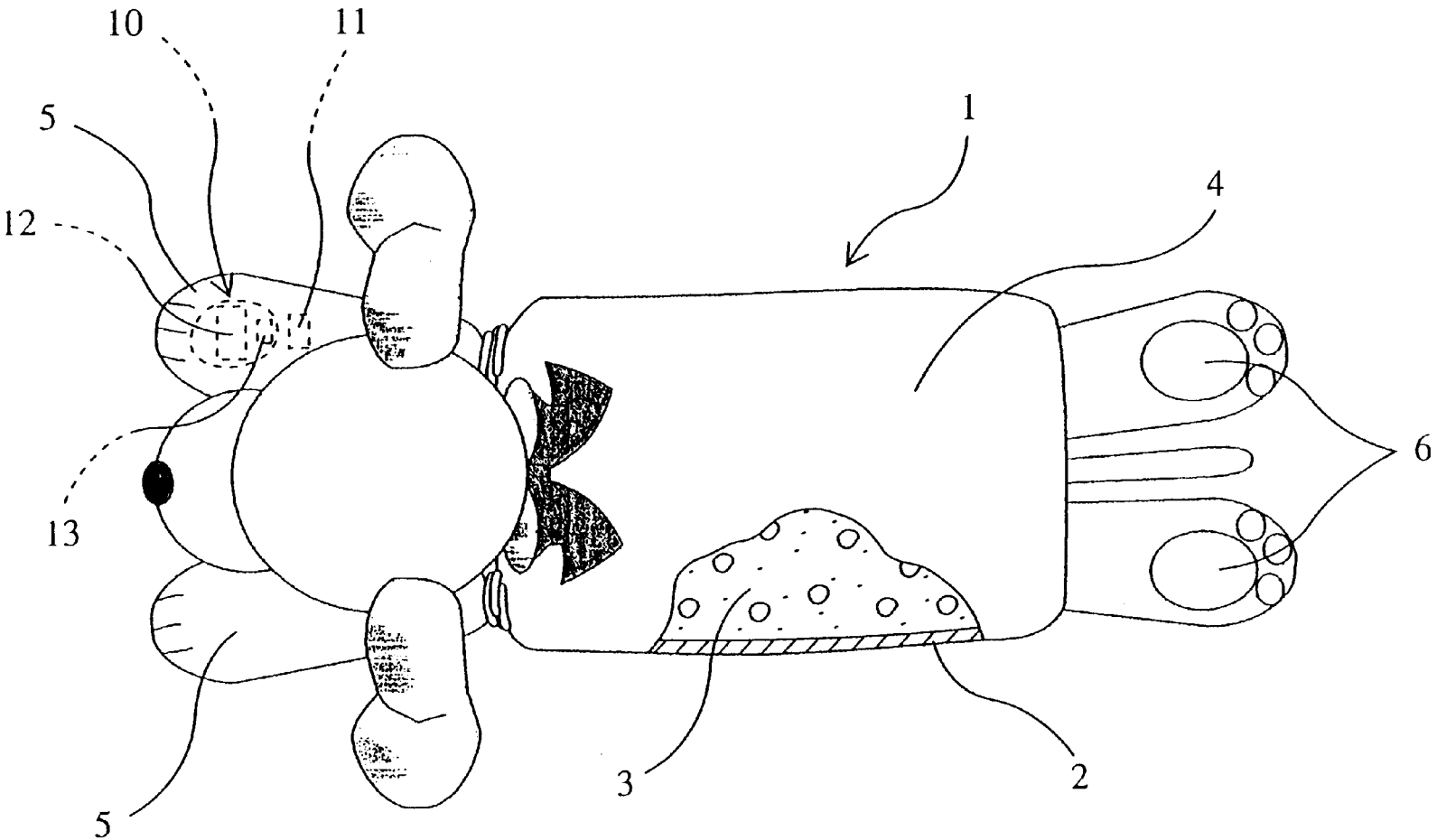
FIG. 1 is a plan view showing an embodiment of a pillow according to the present invention.

Referring first to FIG. 1, an embodiment of a pillow according to the present invention is illustrated. A pillow of the illustrated embodiment which is generally designated at reference numeral 1 is embodied in the form of a stuffed doll made in imitation of a dog.

The pillow 1 is constituted of an outer member 2 and a stuffing member 3 filled in the outer member 2. In the illustrated embodiment, the outer member 2 may be made of cotton and the stuffing member 3 may be made of polystyrene foam.

The pillow 1 in the form of a dog includes a trunk section 4 which acts as a support for supporting the head of a user (not shown) thereon. The pillow 1 also includes front feet 5 mounted on both sides of a front portion of the trunk section 4 and rear feet 6 mounted on both sides of a rear portion thereof. The front feet 5 and rear feet 6 are arranged so as to be movable in horizontal and vertical directions and/or reversible. The feet 5 and 6 may be attached to the trunk section 4 by sewing. Further, the pillow 1 includes a head 7 mounted on a substantially central position of the front portion of the trunk section 4. The head 7 is mounted on both sides thereof with ears. 8 in a manner to be horizontally and vertically movable and/or reversible.

The outer member 2 may be made of any suitable material other than cotton such as; for example, polyester, satin, high pile or the like. Likewise, the stuffing member 3 may be made of any suitable material other than polystyrene foam such as, for example, buckwheat chaff, urethane, cotton or the like.

The pillow 1 also includes an alarm means 10 arranged on a distal end of one of the front feet 5 or a portion thereof in proximity to the distal end so that it may be visible by reversing the front foot 5. The alarm means 10 is arranged in association with a timer 11, to thereby be actuated through the timer 11. The timer 11 may be constructed in a manner commonly known.

Figure 2:
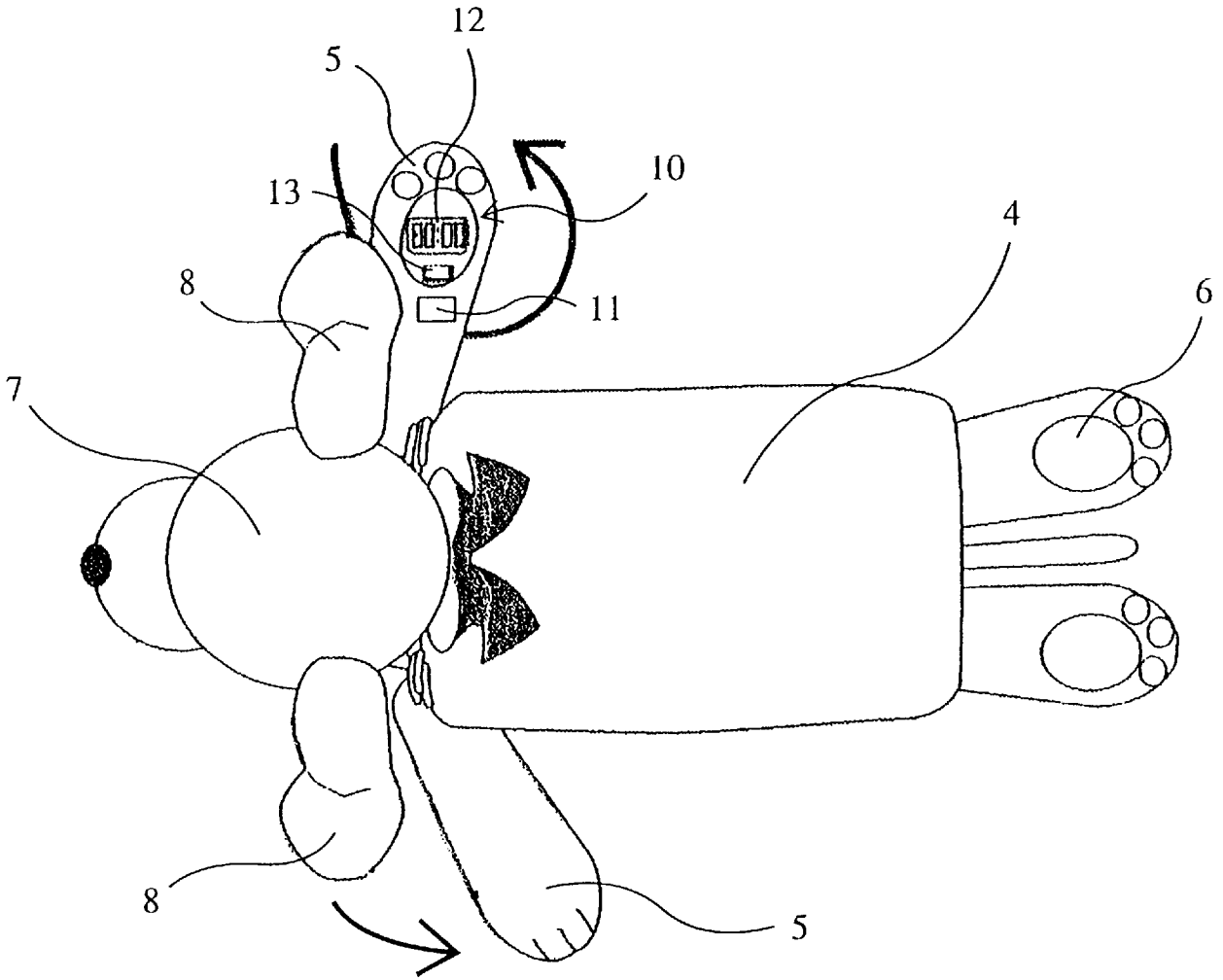
FIG. 2 is a plan view of the pillow shown in FIG. 1, wherein one of front feet which is provided with an alarm means is reversed.
Figure 3:
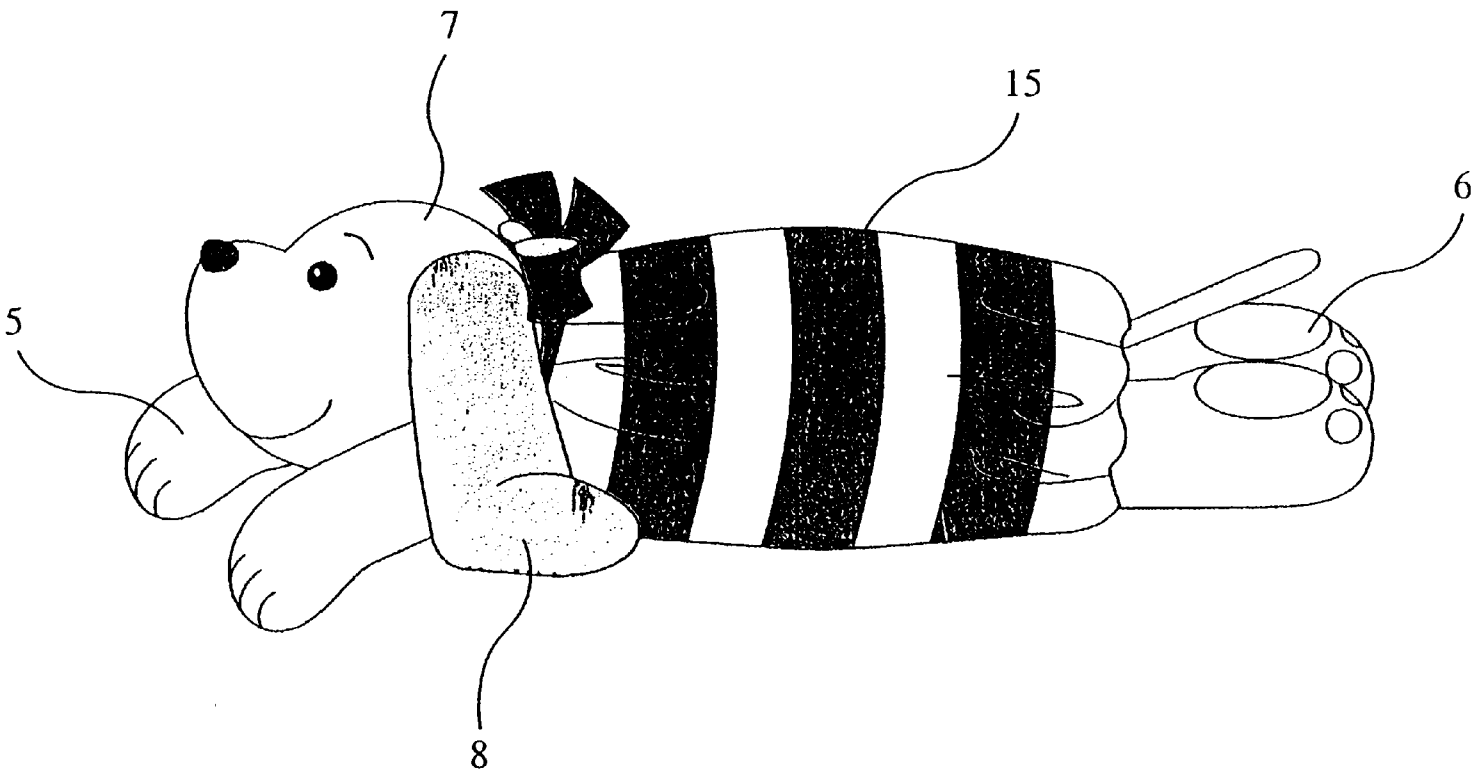
FIG. 3 is a side elevation view of the pillow shown in FIG. 1 which is covered with a pillowcase.

The alarm means 10, as shown in FIG. 2, may include a clock display section 12 and a sound/voice generation section 13 and may be constructed so as to generate sound or voice when the timer 11 indicates predetermined time. The timer 11 is driven by a cell acting as a drive source.

Alternatively, the alarm means 10 may be constructed so as to generate vibration, light or the like other than sound/voice. Also, the timer 11 may be actuated through either a commercial AC power supply or a spring.

The trunk section 4 of the pillow 1 in the form of a dog may be covered with a pillowcase 15 made of a pile fabric. The pillowcase 15 may be detachably arranged on the trunk section 4.

Now, the manner of operating of the pillow 1 of the illustrated embodiment thus constructed will be described hereinafter.

The head of a user is supported on the pillow 1 and more specifically the trunk section 4 while asleep. When the user must get up earlier than usual the next day in view of his or her schedule, the timer 11 is set at the hour of rising. Actuation of the timer 11 at the time permits the alarm means 10 to generate sound or voice.

The pillow 1 of the illustrated embodiment is formed in imitation of a dog, to thereby exhibit attractive appearance and unexpectedness. Also, it prevents a user from having a sense of incompatibility in use and fits the head of the user to a degree sufficient to give the user comfortableness.

Also, when a user must get up at predetermined time, the pillow of the illustrated embodiment permits setting of the timer at the time, to thereby actuate the alarm means 10 and wake up the user.

Further, incorporation of the alarm means 10 in the pillow 1 in the illustrated embodiment eliminates a hindrance by the alarm means, to thereby render a user's bedside neat.

In the illustrated embodiment, the pillow 1 is formed in imitation of a dog, however, the present invention is not limited to such a form. It may be made in imitation of, for example, a cat, a rabbit or the like. Also, the alarm means 10 may be arranged at one of the rear feet 6, the head 7, the ear 8 or the like other than the front feet 5.

As can be seen from the foregoing, the pillow of the present invention is so constructed that the stuffed doll is made in imitation of a real or fanciful animal or the like and the alarm means is arranged at a predetermined portion of the stuffed doll. Such construction permits the pillow to exhibit attractive appearance and unexpectedness and prevents a user from having a sense of incompatibility in use. Also, it permits the pillow to fit the head of the user to a degree sufficient to give the user comfortableness.

Also, in the pillow of the present invention, the alarm means may be actuated through the timer, resulting in reliable actuation of the alarm means being ensured.

Further, in the present invention, the timer may be driven through the drive source selected from the group consisting of a cell and a spring. This permits durability of the timer to be increased.

In addition, the alarm means may be constructed so as to generate sound, voice, vibration, light or the like. This permits the pillow of the present invention to be suitably used depending on a place, a situation, a circumstance and the like.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A pillow comprising:

a stuffed doll made in imitation of a real or fanciful animal having a trunk section for supporting the head of a user and at least one distal section having a rear side and a front side and mounted on said trunk section; and an alarm arranged at said at least one distal section.

2. A pillow as defined in claim 1, wherein said alarm is actuated through a timer.

3. A pillow as defined in claim 2, wherein said timer is driven through a drive source selected from the group consisting of a cell and a spring.

4. A pillow as defined in claim 1, wherein said alarm is constructed so as to generate at least one of sound, voice, vibration and light.

5. A pillow as claimed in claim 1, wherein said at least one distal section of said stuffed doll includes at least one of a head, a front foot, a rear foot and an ear mounted on said truck section.

6. A pillow as claimed in claim 1 wherein said distal section is movable relative to said trunk section.

7. A pillow as claimed in claim 1 wherein said alarm is arranged on a distal end of said distal section or a portion of the distal section in proximity to the distal end of the distal section.

8. A pillow as claimed in claim 1 wherein said alarm is arranged on the rear side of the distal section so as to be made visible by reversing the distal section.

9. A pillow comprising:

a stuffed doll made in the imitation of a real or fanciful animal having a trunk section for supporting the head of a user and at least one distal section having a rear side and a front side and mounted on said trunk section, said distal section is movable relative to said trunk section;

and an alarm arranged on the rear side of the distal section so as to be made visible by reversing the distal section.

10. A pillow as defined in claim 9, wherein said alarm is actuated through a timer.

11. A pillow as defined in claim 10, wherein said timer is driven through a drive source selected from the group consisting of a cell and a spring.

12. A pillow as defined in claim 9, wherein said alarm is constructed so as to generate at least one of sound, voice, vibration and light.

13. A pillow as claimed in claim 9 wherein said at least one distal section of said stuffed doll includes a head, front feet, rear feet, and ears mounted on said trunk section.

14. A pillow comprising:

a stuffed doll made in imitation of a real or fanciful animal having a trunk section for supporting the head of a user and at least one distal section mounted on said trunk section; and an alarm arranged at a predetermined portion of said distal section, said distal section being movable relative to said trunk section between a first position which permits said alarm to be made invisible and a second position which permits said alarm to be made visible.

15. A pillow as defined in claim 14, wherein said predetermined portion on which said alarm is arranged is a distal end of said distal section or a portion in proximity to the distal end of said distal section.

16. A pillow as defined in claim 15, wherein said distal section is constructed such that said alarm is made visible by reversing said distal section from said first position to said second position.

17. A pillow as defined in claim 14, wherein said alarm is actuated through a timer and constructed to generate at least one of sound, voice, vibration and light.

* * * * *